US008686856B2

(12) United States Patent
Stefanelli

(10) Patent No.: US 8,686,856 B2
(45) Date of Patent: Apr. 1, 2014

(54) ANTI-THEFT DEVICE FOR CONTAINERS OF FLUID PRODUCTS

(76) Inventor: Paolo Stefanelli, Milan (IT)

( * ) Notice: Subject to any disclaimer, the term of this patent is extended or adjusted under 35 U.S.C. 154(b) by 908 days.

(21) Appl. No.: 12/668,272

(22) PCT Filed: Jul. 10, 2007

(86) PCT No.: PCT/IT2007/000491

§ 371 (c)(1),
(2), (4) Date: Jan. 15, 2010

(87) PCT Pub. No.: WO2009/008013

PCT Pub. Date: Jan. 15, 2009

(65) Prior Publication Data

US 2010/0171618 A1 Jul. 8, 2010

(51) Int. Cl.
*G08B 13/14* (2006.01)

(52) U.S. Cl.
USPC ..... 340/572.1; 340/572.8; 340/572.7; 340/572.3

(58) Field of Classification Search
USPC ..... 340/572.1, 572.8, 572.7, 572.3
See application file for complete search history.

(56) References Cited

U.S. PATENT DOCUMENTS

| | | | | |
|---|---|---|---|---|
| 4,592,301 | A | 6/1986 | Monte | |
| 6,031,457 | A | 2/2000 | Bonkowski et al. | |
| 7,176,796 | B2 * | 2/2007 | Chen et al. | 340/568.1 |
| 7,948,381 | B2 * | 5/2011 | Lindsay et al. | 340/572.3 |
| 7,969,308 | B2 * | 6/2011 | Cotton | 340/572.1 |
| 7,973,664 | B1 * | 7/2011 | Lambert et al. | 340/572.8 |
| 2004/0008123 | A1 * | 1/2004 | Carrender et al. | 340/825.49 |
| 2005/0128087 | A1 * | 6/2005 | Claessens et al. | 340/572.8 |
| 2005/0258931 | A1 * | 11/2005 | Rommelmann et al. | 340/5.1 |
| 2006/0049948 | A1 * | 3/2006 | Chen et al. | 340/572.7 |
| 2007/0120701 | A1 | 5/2007 | Teller | |
| 2007/0182563 | A1 * | 8/2007 | Abbott | 340/572.8 |
| 2008/0068178 | A1 * | 3/2008 | Meyer | 340/572.8 |
| 2008/0258401 | A1 * | 10/2008 | Cotton | 277/321 |

FOREIGN PATENT DOCUMENTS

| | | | |
|---|---|---|---|
| DE | 93 15 902 | U1 | 1/1994 |
| WO | 99/65003 | A1 | 12/1999 |

* cited by examiner

*Primary Examiner* — Hoi Lau
(74) *Attorney, Agent, or Firm* — Pearne & Gordon LLP

(57) ABSTRACT

An anti-theft device for containers of fluid products comprising: a support element (3) connected to a container (2) to be monitored and attached to the inside of a neck (6) of container (2), between the neck (6) itself and a closure member (11) which is irremovably attached to container (2); and a circuit (7) at least partially housed in said support element (3) to receive an enquiry signal (S1) and to generate a corresponding response signal (S2).

18 Claims, 4 Drawing Sheets

ANTI-THEFT DEVICE FOR CONTAINERS OF FLUID PRODUCTS

The present invention refers to an anti-theft device for containers of fluid products.

In particular the present invention has a specific application as an anti-shoplifting system for containers, flasks or bottles containing cosmetic products such as, for example, perfumes.

As is well-known, there is a habitual practice of using on containers for sale, and in particular on containers of cosmetic products, tags which have a dual purpose: to state the brand, model, price and any other descriptive details of the product, and to prevent such containers being stolen or at all events removed in an illicit and uncontrolled manner from the area in which they ought to remain positioned.

The anti-theft or anti-shoplifting action is achieved thanks to a circuit housed inside the tag; this tag generally includes a memory in which is contained an identification code for the product, a transmission module, to generate a signal incorporating at least this identification code, and an antenna, for transmitting this signal.

As long as the container and the relative tag are located in a predefined area, suitably monitored, the circuit dialogues on a predefined frequency with the monitoring system, in such a way that the latter can have continual confirmation of the presence of the product in the predefined area.

If at any time the system no longer detects the presence of the tag (and therefore, presumably, of the container associated with it), it generates a suitable signal, to keep track of this absence.

If the absence of the container corresponds to the recording of a sales operation, the system will terminate its monitoring activity.

If, however, the absence of a tag does not correspond to any sales operation, the system generates an alarm signal, to indicate the irregular situation.

Typically a tag of known type is attached to the respective container for example by gluing.

However, it is clear that systems of known type such as those described above can be easily eluded, by detaching the tag from the respective container and leaving the tag in a suitable position within the monitored area.

In this way the system will not be able to detect the absence of the container, precisely because the corresponding tag is in the predetermined place, so that no irregularity can be verified.

Furthermore, in the case of containers of high value, such as perfumes for example, the containers can be opened and decanted into other containers in order to remove the contents.

In this case, too, the system does not detect any anomaly because the empty container with the respective tag remains inside the monitored area.

An object of the present invention is therefore to make available an anti-theft device for containers of fluid products which can be attached with greater reliability to the respective container Another object of the present invention is to provide a device which allows more reliable processes of monitoring and checking to be implemented than those which are usually made available by the state of the art.

Another object of the present invention is to make available a device capable of detecting the illicit opening of the container within a predefined monitoring area.

Finally, it is an object of the present invention to make available a device with a structure which is simple to construct, costing limited amounts to manufacture and which, notwithstanding its greater reliability by comparison with known devices, has substantially the same bulk.

These and yet other objects are substantially achieved by an anti-theft device for containers of fluid products according to the descriptions given in the attached claims.

Further characteristics and advantages will appear more clearly from the detailed description of a preferred, but not exclusive, embodiment of an anti-theft device according to the invention.

This description is provided with reference to the attached drawings, these too having a purely exemplary and therefore non-limiting purpose, in which.

Figure 5:
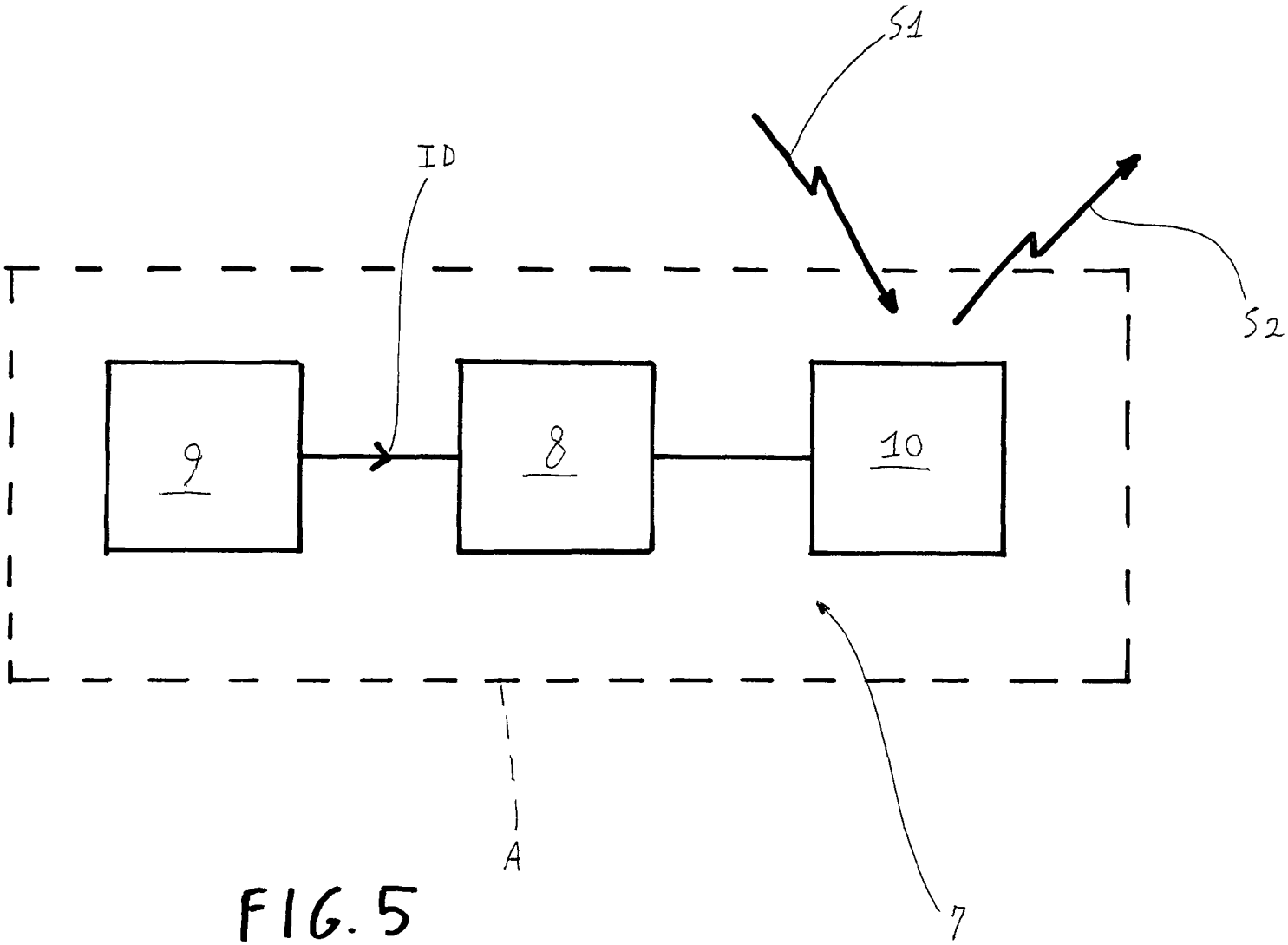
FIG. 5 shows a block diagram of a circuit forming part of the device shown in FIG. 1.
Figure 6A:
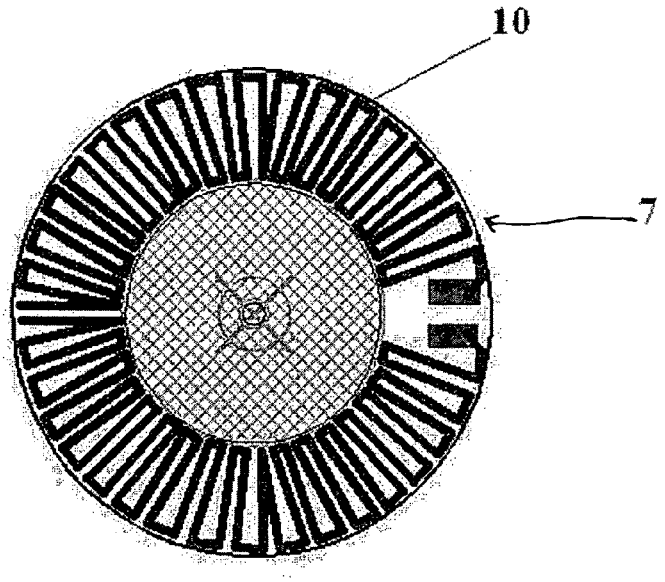
Figure 6B:
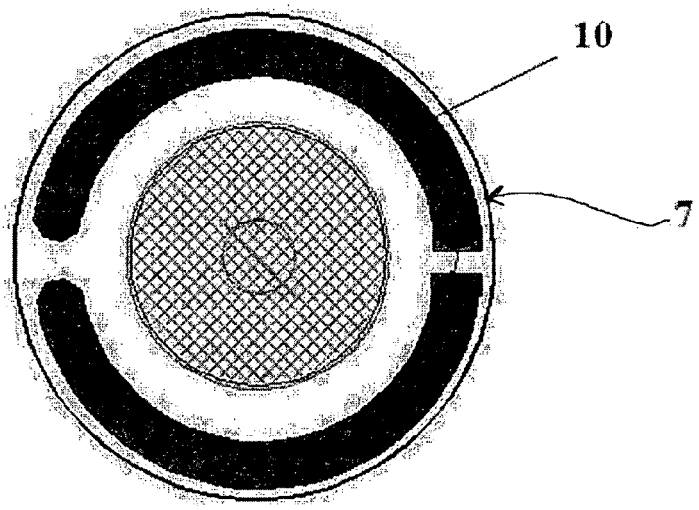
Figure 6C:
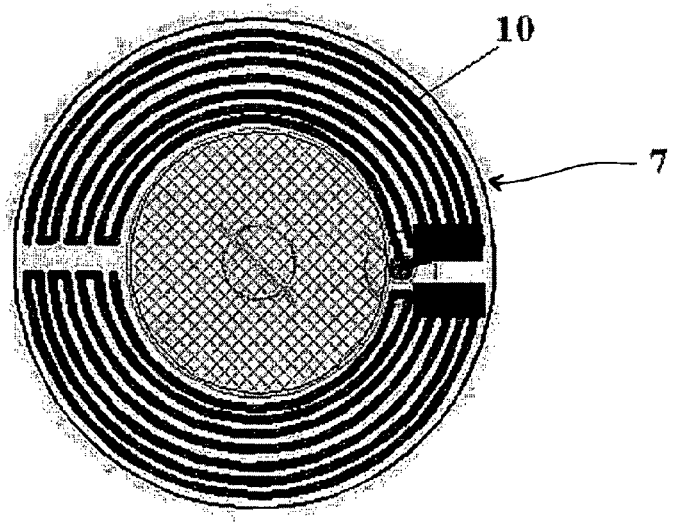

FIGS. 6*a*, 6*b* and 6*c* show, schematically, possible embodiments of a circuit-like element of the circuit shown in FIG. 5.

With reference to the figures mentioned, no. 1 comprehensively denotes an anti-theft device in accordance with, the present invention.

Device 1 is advantageously used for containers 2 for fluid products.

In particular the present invention has a specific application in containers 2 such as flasks, bottles or phials of cosmetic products in liquid or semi-liquid form such as foams, gels etc.

Preferably, the present invention has an advantageous use in containers 2 of perfumes of high commercial value.

However, it must be clearly stated that the present invention can be used for any container 2 equipped with a hollow body 2*a* capable of containing fluid products of various kinds.

Device 1 includes, a support element 3, connected to the above-mentioned container 2 to be monitored.

Support element 3 is preferably made up of a substantially annular body 4, forming a cavity 5 allowing passage through it and formed in rigid or semi-rigid material, not subject to structural alteration on contact with the above-mentioned liquid. For example, support element 3 can be made in plastic material, elastomeric material etc.; in general support element 3 can be made in any material capable of forming a label to be attached to a container 2 which must be kept under control.

Support element 3 can be housed above a neck 6 (FIG. 1) of container 2, presenting a substantially cylindrical conformation, and forming internally an opening for the passage of liquid.

Figure 3:
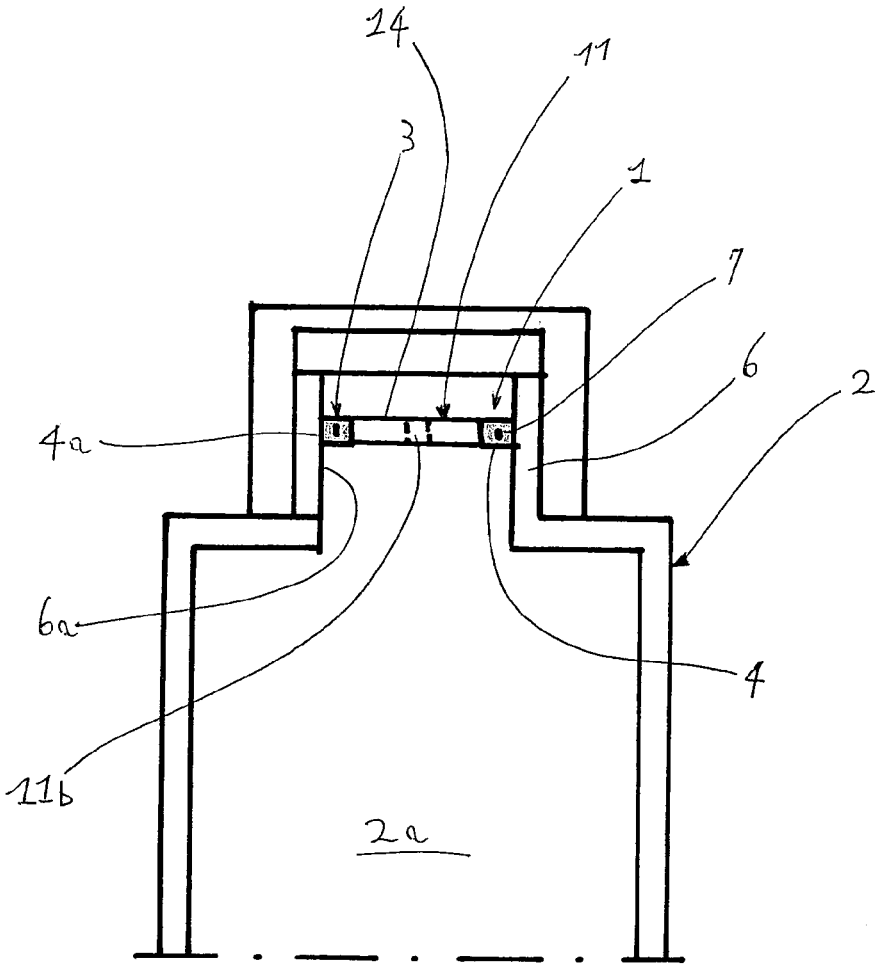
FIG. 3 shows a schematic view in lateral elevation and in section of a further embodiment of the device according to the invention, connected to a respective container which is only partially illustrated.

Alternatively, in accordance with a second embodying solution illustrated in FIG. 3, support element 3 can be housed inside neck 6.

It should be noted that in this embodying solution, annular body 4 forming support element 3 proves to be preferably coaxial to neck 6 of container 2, with a respective external surface 4*a* facing onto an internal surface 6*a* of neck 6 itself.

Device 1 includes furthermore a circuit 7, illustrated schematically in the attached drawings, at least partially housed in support element 3.

Circuit 7 is configured to receive an enquiry signal S1, and to generate a corresponding response signal S2. Enquiry signal S1 preferably forms an electromagnetic field in which device 1, and container 2 to which it is connected, are located in normal conditions of use. Enquiry signal S1 is propagated inside a predefined area "A" which must be monitored, such as for example a shop or a warehouse in which the above-mentioned container 2 is housed.

The electromagnetic field generated by enquiry signal S1 is responsible for supplying circuit 7, which is activated and consequently generates response signal S2.

Circuit 7 can be made for example as an ISO TAG circuit operating at 13.56 MHz, or as a UHF TAG; the latter in particular can be particularly useful in the case of readings at great distances.

Circuit 7 can also be made as an LF TAG circuit, operating for example at 125 KHz.

Preferably circuit 7 is provided with a transmission circuit 8 for generating the response signal S2. Circuit 7 includes furthermore a memory 9 for containing an identification code ID uniquely associated with product 2.

In other words, product 2 has an identification code ID associated with it, which allows it to be recognized even among a plurality of completely identical products; this identification code ID is stored in memory 9 of circuit 7.

In the preferred embodiment, memory 9 is operationally associated with transmission module 8 to incorporate the identification code ID in the response signal S2.

Circuit 7 includes furthermore an antenna 10 for receiving, by means of enquiry signal S1, the energy necessary for supplying transmission module 8 for generating response signal S2.

Preferably, antenna 10 is also used for the transmission of response signal S2.

In this way the monitoring system (which will be more fully described below), by recognizing the various identification codes of the devices present in area "A", can be always aware of the presence of these devices and therefore detect the absence of one or more of said devices, which presumably implies the absence of the products associated with them.

FIGS. 6*a*, 6*b* and 6*c* show, by way of example, possible conformations of antenna 10.

Circuit 7 is at least partially supported by support element 3, or at least partially housed in support element 3.

Preferably, circuit 7 is integrated at least partially into support element 3 in irremovable manner. In other words, circuit 7 is stably connected with element 3, for example by means of being glued to it. Alternatively, in the event that support element 3 is made in plastic, circuit 7 is embedded in support element 3 itself.

Advantageously, support element 3 is interposed between neck 6 of container 2 and a closure member 11 of container 2 itself.

In particular, closure member 11 is irremovably connected to neck 6 to at least partially open/close the opening for the passage of liquid and extends at least partially into the inside of neck 6 itself.

In this situation, closure member 11 is commutable between a closure condition in which it is connected to container 2 and an opening position in which it is at least partially distanced from container 2 itself.

Figure 1:
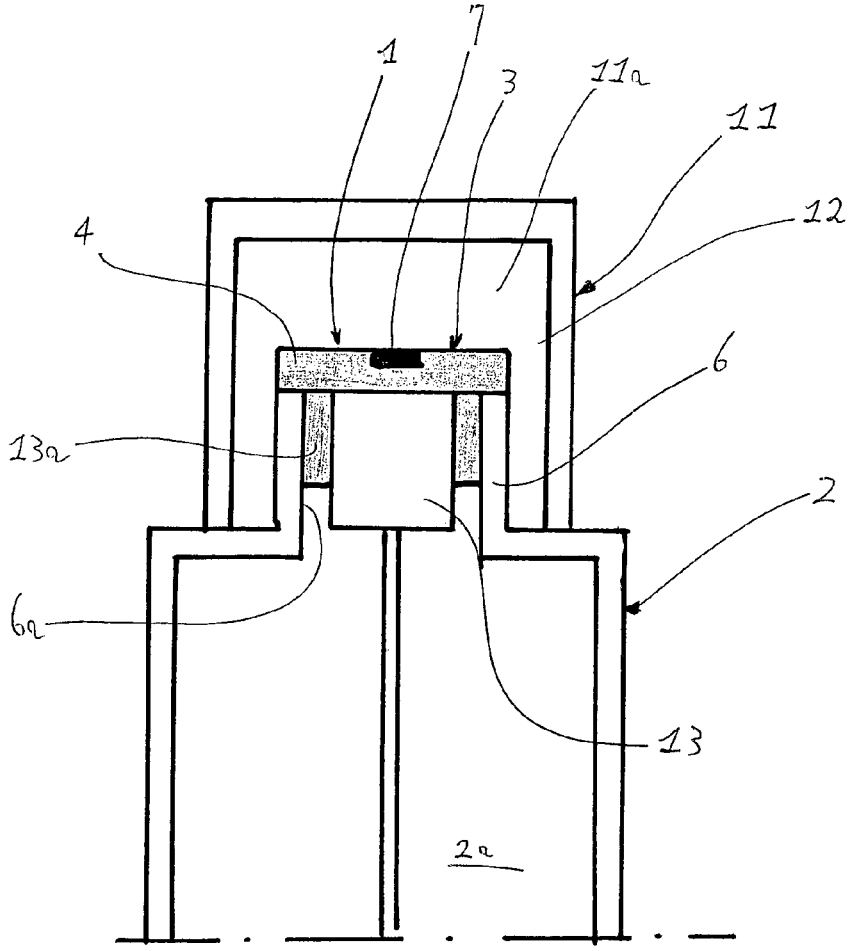
FIG. 1 is a schematic view in lateral elevation and in section of a device according to the invention, connected to a respective container which is only partially illustrated.
Figure 2:
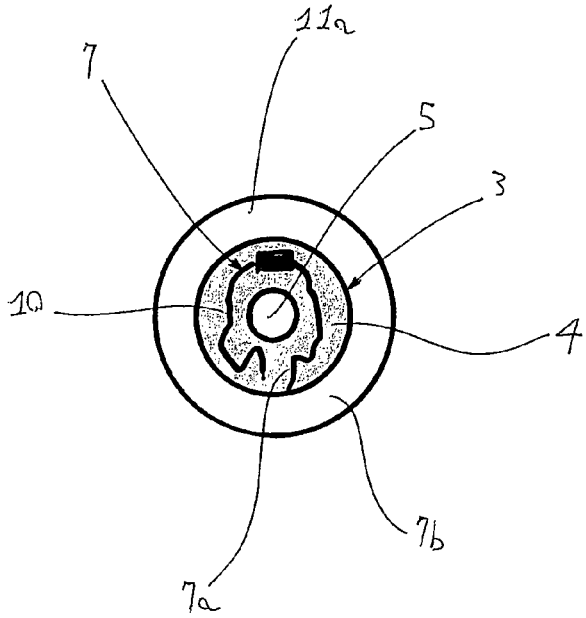
FIG. 2 shows a schematic plan top view of the device shown in FIG. 1 connected to the respective container, from which some parts have been removed to better illustrate others.

It should be noted that, in accordance with the first embodying solution illustrated in FIGS. 1 and 2, closure member 11 can consist of a vaporizer 12 having a pump 13 for suctioning the liquid contained in container 2.

Pump 13 has a substantially cylindrical conformation and is fitted inside cavity 5 of annular body 4. In this situation, pump 13 abuts onto a cylindrical support 13*a* forming part of support element 3 and capable of bearing support element 3 itself. Cylindrical body 13*a* is fitted into the inside of neck 6 and presents a cylindrical internal surface connected to the above-mentioned pump 13.

Figure 4:
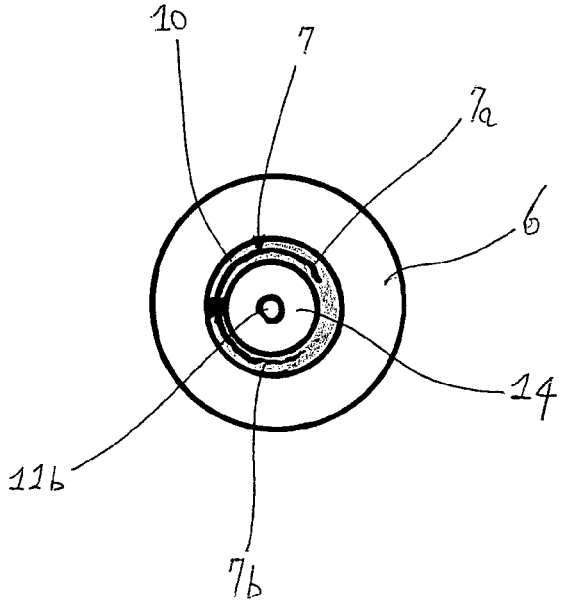
FIG. 4 shows a schematic plan top view of the device shown in FIG. 3 connected to the respective container, from which some parts have been removed to better illustrate others.

In accordance with the second embodying solution illustrated in FIGS. 3 and 4, closure member 11 can consist of an annular gasket 14, preferably made of plastic and elastically deformable.

In this situation also, gasket 14 is fitted inside cavity 5 of annular body 4 to abut onto the above-mentioned internal surface 4*a*.

Preferably, closure member 11 presents a through hole 11*b* to allow a minimal egress of the fluid in container 2; to cause such an egress, a user can exert pressure on the lateral walls of container 2, or shake the container itself in a direction defined by the longitudinal extension of container 2.

In general, when closure member 11 is in the closure position, the egress of fluid from container 2 is still permitted, but in extremely reduced quantities, to allow the user to suitably meter the quantity of product which she intends to use. The egress is permitted, in particular, by the vaporizer 12 and pump (FIGS. 1 and 2), or by the through hole 11*b* (FIGS. 3 and 4).

Vice versa, when the closure member is in the opening position, the egress of fluid from container 2 is no longer controlled and container 2 can be emptied very rapidly.

It must be stated that, in both the solutions described above and illustrated respectively in FIGS. 1, 2, 3 and 4, circuit 7 includes preferably at least one first and one second portion 7*a*, 7*b* in operational communication with each other when closure member 11 is connected to container 2. By contrast, when closure member 11 is at least partially disconnected from container 2, the above-mentioned portions 7*a*, 7*b* are separated from each other.

In other words, circuit 7 is in a normal operational condition of use in which it is able to receive and/or generate signals S1, S2 when closure member 11 is connected to container 2 in the respective closure condition. When, however, closure member 11 is in the opening condition in which it is disconnected from container 2 (for example in the case of theft), circuit 7 is in a non-operational condition in which it is not able to receive and/or generate signals S1, S2.

The first and second portions 7*a*, 7*b* are in operational communication with each other when they are substantially in a condition of mutual electrical contact, so that circuit 7 can function correctly.

First and second portions 7*a*, 7*b* are separated from each other when they are not in a condition of mutual electrical contact, and circuit 7 can consequently not function correctly.

To put it in other terms, when the first and second portions 7*a* and 7*b* are in operational communication with each other, if circuit 7 is suitably supplied (preferably by means of enquiry signal S1), it is capable of generating and transmitting response signal S2. Vice versa, when the first and second portions 7*a* and 7*b* are separated from each other, even in the presence of a suitable power-supply, typically obtained by means of enquiry signal S1, circuit 7 is not capable of generating and transmitting response signal S2.

First and second portions 7*a*, 7*b* of circuit 7 preferably constitute the above-mentioned antenna 10 and can be made in one piece to form a prolonged element extending into support element 3.

These portions 7*a*, 7*b* are separable from each other following damage to circuit 7 itself. In other words, when closure member 11 is removed at least partially from container 2 (opening condition), support element 3 undergoes a slight bending which entails damage to circuit 7. This damage entails the breakage and separation of first portion 7*a* from second portion 7*b*. The separation between the first and second portions 7*a*, 7*b* can be considered, in this case, irreversible, because the breakage of the wire forming antenna 10 can be repaired only through an extremely complex operation, and a costly one from the economic point of view.

Alternatively, the first and second portions 7*a*, 7*b* can be made as two separate elements which are normally in a condition of mutual electrical contact.

In this situation, first portion 7*a* has a prolonged element extending into support element 3, while second portion 7*b* is constituted by a conductive element 11*a* of closure member 11.

This conductive element 11*a* is made of metallic material and is in contact with the above-mentioned support element 3 (FIG. 1).

In this way, first and second portions 7*a*, 7*b* are in mutual electrical contact in the closure condition of member 11, and in a condition of non-electrical contact or isolation in the opening condition of member 11.

In practice, the conductive element can be made as a metallic plug, fixed to neck 6 of container 2 so as to maintain itself in a condition of electrical contact with the first portion 7*a* of circuit 7.

Advantageously, in the event that an individual wanted to try to remove container 2 from the predefined area "A", they would have two possibilities:

- they could simultaneously remove container 2 and device 1 and then try to get away, but the absence of device would be noticed, because the relative response signal S2 would no longer be received
- or they could open container 2 and extract the liquid; however, to open the container 2 it would be necessary to remove closure member 3 and take it into the respective opening position, breaking circuit 7 and thus preventing antenna 10 from operating correctly and generating response signal S2. Therefore in the second case as well, generation of the response signal S2 would be interrupted and the control system would be able to detect the abnormal situation.

The system in which device 1 is operating is capable of generating the above-mentioned enquiry signal S1, which is suitably directed over predefined area "A" in which container 2 is positioned, and from which container 2 cannot be removed without authorization. Furthermore, this system is capable of receiving the response signal S2 generated by one or more devices 1.

In the event that one or more response signals S2 are not received in a determinate time-interval, the control system proceeds to generate a warning signal, for the staff, that an abnormal situation is occurring. Advantageously, device 1 can also be used for control of the flow of containers 2, from the manufacture/production stage as far as the retail sales stage and the journey to the cash desk.

Device 1 also makes it possible to monitor and follow in real time the variations in stock levels in warehouses or other storage areas.

The warning signal can also be a signal which allows an automated monitoring system to keep track of the movements of a certain device 1 and the container 2 to which it is attached.

Again, the above-mentioned control area "A" can be defined in terms of very small spaces, to allow the user to carry out a local reading by means of a suitable portable device. In this situation, checking of device 1 is performed by bringing the above-mentioned portable device into proximity with container 2 which must be monitored.

The invention achieves important advantages.

The device according to the invention can in fact be extremely reliably attached to the container to which it is connected, given that the supervision system, thanks to the device which is the subject of the invention, is put into the condition of being able to detect immediately any separation of the closure member from the container.

Add to this a greater reliability for the entire monitoring system, which can effectively detect any attempted theft, tampering or unauthorized movement.

It should furthermore be noted that device 1 is inside neck 6 and therefore hidden and difficult to reach for the purpose of any attempt to remove it.

Other advantages are to be found in the fact that the device according to the invention presents a structure which is simple to construct, costing limited amounts to manufacture and which, notwithstanding its greater reliability by comparison with known devices, has substantially the same bulk.

The invention claimed is:

1. An anti-theft device for containers of fluid products comprising:

- a container for fluid products;
- a support element (3) connected to said container (2);
- a closure member (11) irremovably attached to said container (2); and
- a circuit (7) housed in said support element (3) to receive an enquiry signal (S1) and to generate a corresponding response signal (S2);

wherein said support element (3) is interposed between said container (2) and said closure member (11), wherein said circuit (7) comprises at least one first and one second portion (7*a*, 7*b*), wherein said first portion (7*a*) is an elongated element extending into said support element (3) and said second portion (7*b*) is a conductive element (11*a*) of said closure member (11), said first and second portions (7*a*, 7*b*) being in mutual electrical contact when said closure member (11) is connected to said container (2) and being in a condition of mutual non-electrical contact or isolation when said closure member (11) is at least partially disconnected from said container (2).

2. A device according to claim 1, wherein said circuit (7) is in an operational condition in which it receives and/or generates said signals (S1, S2) when closure member (11) is connected to container (2), and is in a non-operational condition in which it does not receive and/or does not generate said signals (S1, S2) when closure member (11) is at least partially disconnected from said container (2).

3. A device according to claim 2, wherein said closure member (11) is in a respective closure position when it is connected to said container (2), and in an at least partial respective opening position when it is at least partially disconnected from container (2).

4. A device according to claim 3, wherein said first and second portions (7*a*, 7*b*) are made in one piece; said circuit (7*a*, 7*b*), in the opening condition of closure member (11), being divided into at least said first and second portions (7*a*, 7*b*).

5. A device according to claim 1, wherein said circuit (7) comprises an antenna (10) for the transmission and/or reception of said signals (S1, S2).

6. A device according to claim 1, wherein said circuit (7) comprises an antenna (10) for the transmission and/or reception of said signals (S1, S2) and wherein said first and second portions (7*a*, 7*b*) constitute the antenna (10) of said circuit (7).

7. A device according to claim 1, wherein said support element (3) is housed above a neck (6) of container (2) presenting internally an opening for the passage of fluid.

8. A device according to claim 1, wherein said support element (3) is housed inside a neck (6) of container (2) presenting internally of opening for the passage of fluid.

9. A device according to claim 7, wherein said support element (3) presents a substantially annular body (4) forming a passage cavity (5), said closure member (11) extending at least partially inside said passage cavity (5).

10. A device according to claim 9, wherein said closure member (11) comprises a vaporiser (12) presenting a suction pump (13) abutting on an internal surface of annular body (4).

11. A device according to claim 9, wherein said support element (3) is housed inside a neck (6) of container (2) presenting internally an opening for the passage of fluid, and wherein said closure member (11) comprises an annular gasket (14) abutting on an internal surface (4*b*) of annular body (4).

12. A device according to claim 5, wherein said circuit (7) comprises a transmission module (8) to generate said response signal (S2), connected to said antenna (10).

13. A device according to claim 12, wherein said circuit (7) also comprises a memory (9) to contain an identification code (ID) associated with said container (2).

14. A device according to claim 13, wherein said memory (9) is operationally associated with said transmission module (8) to incorporate said identification code (ID) in said response signal (S2).

15. A container for fluid products comprising:

a hollow body (2*a*) for containing at least one fluid product;

a neck (6) projecting from said hollow body (2*a*) and presenting an opening for the passage of said fluid; and a closure member (11) attachable to the neck (6) between a closure position in which it, at least partially, occludes the passage opening and an opening position in which it does not occlude said opening;

an anti-theft device (1) according to claim 1.

16. A container according to claim 15, wherein said fluid product is a cosmetic.

17. A device according to claim 12, wherein said circuit (7) also comprises a memory (9) to contain an identification code (ID) associated uniquely with said container (2).

18. A container according to claim 15, wherein said fluid product is a perfume.

* * * * *